US008517368B1

(12) United States Patent
Brundige et al.

(10) Patent No.: US 8,517,368 B1
(45) Date of Patent: Aug. 27, 2013

(54) STAPLER EJECT WITH ALTERNATING OFFSET AND POSITION CONTROLLED GRIP

(75) Inventors: Michael J. Brundige, Rochester, NY (US); Brian C. Cyr, Penfield, NY (US); Aaron M. Moore, Fairport, NY (US); Matthew M. R. Storey, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 16 days.

(21) Appl. No.: 13/370,504

(22) Filed: Feb. 10, 2012

(51) Int. Cl.
*B65H 37/04* (2006.01)

(52) U.S. Cl.
USPC ..... 270/58.08; 270/58.07; 270/58.17

(58) Field of Classification Search
USPC ..... 270/37, 52.18, 58.07, 58.08, 58.12, 270/58.17, 58.27; 399/407, 408, 410
See application file for complete search history.

(56) References Cited

U.S. PATENT DOCUMENTS

| | | | | |
|---|---|---|---|---|
| 5,007,625 | A | 4/1991 | Kremers et al. | |
| 5,024,430 | A * | 6/1991 | Seki et al. | 270/58.14 |
| 5,407,186 | A * | 4/1995 | Hayama et al. | 270/58.13 |
| 5,513,839 | A | 5/1996 | Green | |
| 6,032,004 | A | 2/2000 | Mirabella, Jr. et al. | |
| 6,047,960 | A | 4/2000 | Kawano et al. | |
| 6,164,511 | A * | 12/2000 | Chung et al. | 227/148 |
| 6,173,949 | B1 | 1/2001 | Visick et al. | |
| 6,997,451 | B2 | 2/2006 | Yoshimura et al. | |
| 2005/0230896 | A1 | 10/2005 | Funada | |
| 2011/0233842 | A1 * | 9/2011 | Matsuo | 270/58.08 |

* cited by examiner

*Primary Examiner* — Leslie A Nicholson, III
(74) *Attorney, Agent, or Firm* — Gibb & Riley, LLC

(57) ABSTRACT

A stapler apparatus includes a clamp positioned to receive and stack sheets from a printing device, a support plate comprising a groove directing the clamp along one path of multiple paths, the multiple paths alternately directing the clamp relatively closer to one of multiple staplers. A first biasing member applies a first force to the clamp toward a closed position, and a first extension applies a second force to the clamp toward an open position. A second biasing member applies a third force to the clamp toward the open position.

15 Claims, 15 Drawing Sheets

STAPLER EJECT WITH ALTERNATING OFFSET AND POSITION CONTROLLED GRIP

BACKGROUND

Embodiments herein generally relate to document processing finisher devices and more particularly to a stapler ejection device that offsets stapled documents.

Cross-process offset is a useful feature in automated staplers. Current designs move the entire staple subsystem to offset incoming sheets, which is time consuming and costly. Offsetting after stapling, during ejection from the stapler, can also require additional controls and motors to direct the position and operate the set clamp. The structures described below allow offsetting during ejection using less complicated and less expensive devices.

SUMMARY

An exemplary stapler apparatus herein is used with any form of printing device. The stapler apparatus includes a clamp positioned to receive and stack sheets from the printing device. At least two electronic staplers are positioned on opposite sides of the clamp and a support plate is positioned adjacent the clamp. The support plate has a proximal end facing toward the printing device and a distal end facing away from the printing device.

The support plate has a Y-groove (having the shape of the letter Y). The clamp is moveable relative to the support plate. An actuator is connected to the clamp, and the actuator moves the clamp relative to the support plate (by moving the clamp toward and away from the printing device). To the contrary, the support plate remains in a fixed distance from the output belt of the printing device.

The Y-groove directs the clamp along one path of multiple paths as the clamp moves from the distal end to the proximal end. The multiple paths are in the shape of the letter Y. The multiple paths alternately direct the clamp relatively closer to one of the staplers (or the other stapler) as the clamp moves from the distal end to the proximal end (along alternate ones of the multiple paths).

Also, an arbitrarily named "first" biasing member is connected to the clamp. The first biasing member applies an arbitrarily named "first" force to the clamp toward a closed position. An arbitrarily named "first" extension is connected to and extends from the distal end of the support plate. The first extension is positioned to contact the clamp when the clamp is located at the distal end of the support plate. The first extension applies a force (an arbitrarily named "second" force) to the clamp toward an open position.

The clamp has a first clamp section, a second clamp section, and an axle connecting the first clamp section to the second claim section. The first clamp section pivots around the axle and changes the relative locations of the ends of the first clamp section and second clamp section to move the clamp between the open position and the closed position. Thus, the open position of the clamp occurs when the clamp has a larger clamp opening relative to the closed position.

Further, an arbitrarily named "second" biasing member is connected to the support plate and to the clamp. For example, mounts can be connected to the distal end of the support plate and to the second biasing member. The second biasing member applies an arbitrarily named "third" force to the clamp toward the open position when the clamp is positioned at the proximal end of the support plate. The second force and the third force are each greater than the first force and overcome the first force to place the clamp in the open position.

In addition, a pin is connected to the clamp. The pin is positioned within the Y-groove in the support plate, and the pin is moveable along a length of the Y-groove. Also, a gate is connected to the support plate. The gate directs the pin into one of the multiple paths of the Y-groove. A cam contacts the gate, and an arbitrarily named "third" biasing member applies an arbitrarily named "fourth" force to the cam. The cam changes the position of the gate, causing the gate to alternately direct the pin into the alternate ones of the multiple paths.

In operation, the clamp grasps stacks of sheets after the staplers have stapled the stacks of sheets. The clamp alternately offsets the stacks of stapled sheets by traveling along alternate ones of the multiple paths of the Y-groove while sequentially clamping successive stacks of stapled sheets.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned offsetting after stapling, during ejection from the stapler, can require many controls and motors to direct the position and operate the set clamp. In view of this, structures described below allow offsetting during ejection and can be operated using only one actuator. More specifically, the structures herein can use a 4-bar linkage with a linear actuator and a "Y" slot guide. With this structure, a stapled set can be ejected in the process direction while being alternately pushed either inboard or outboard to cause the stack of sets to be offset in the cross process direction (perpendicular to the process direction).

The clamping mechanism that holds the stapled set of sheets in place is opened and closed without additional electromechanical hardware. Further, if desired, the mechanism that determines inboard vs. outboard positioning can also not be motor driven, but instead can use a spring-loaded cam to alternate which leg of the "Y" slot the clamp follows. This setup eliminates the need for multiple motors and additional software.

The offsetting ejector herein clamps the set of sheets after they are stapled, and drives the stapled set of sheets forward to be ejected onto a waiting stack. The "Y" slot biases the stapled set of sheets outboard or inboard before releasing the stapled set of sheets to accomplish the desired cross process offsetting.

The structures herein provide a number of features. More specifically, these structures can use a 4-bar linkage with a linear actuator and "Y" slot guide, where the clamp opening and closing is position dependent, and which uses a gate/cam mechanism for alternating inboard and outboard.

Figure 1:
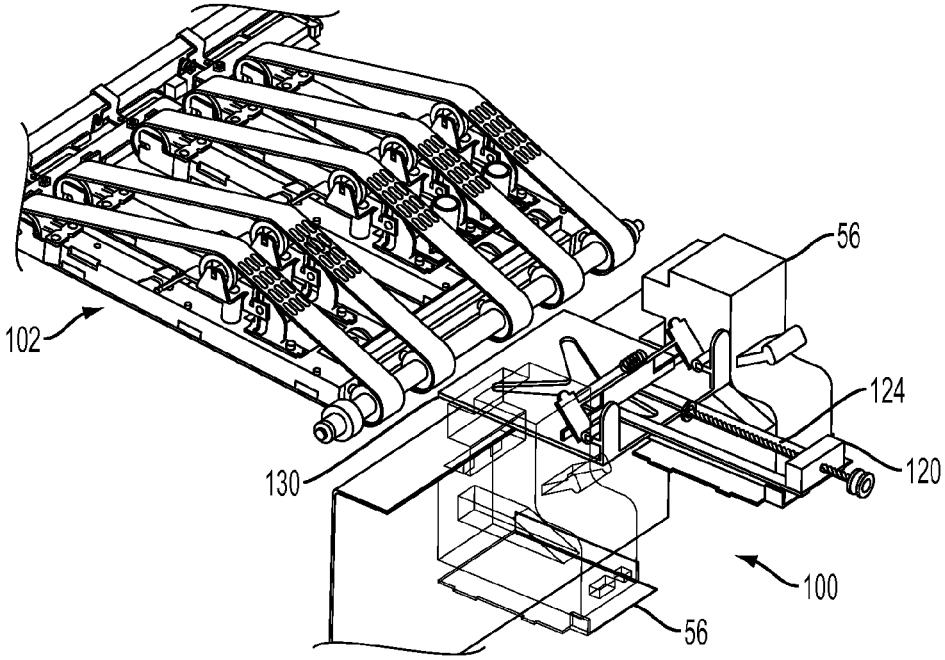
FIG. 1 is a perspective-view schematic diagram of a device according to embodiments herein.
Figure 2:
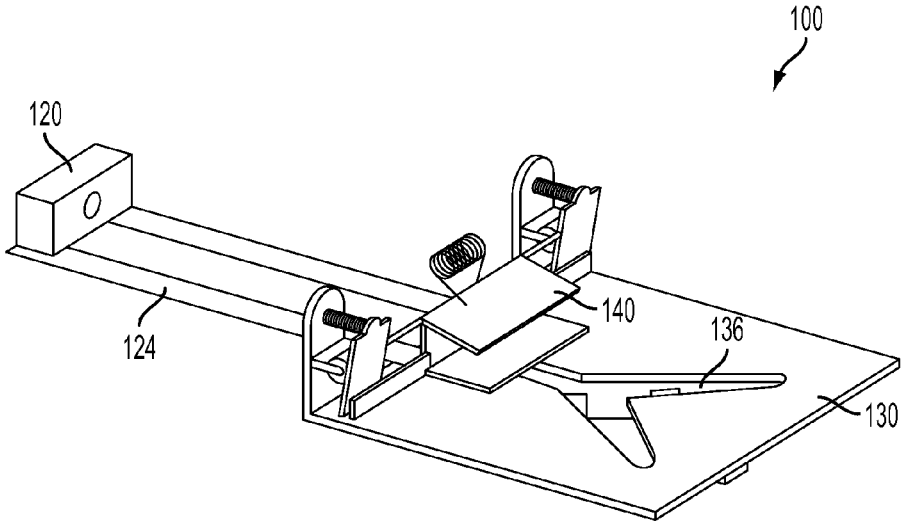
FIG. 2 is a perspective-view schematic diagram of a device according to embodiments herein.

Referring now to FIG. 1, an exemplary sheet processing device, such as a laser cutting device, or a cut-sheet printing device (see FIG. 20 below) can include a sheet transport 102 that outputs sheets of media. The sheets of media are then passed to a finishing device 100 such as stapler that can include multiple electronic automatic staplers 56 (one of which is shown in transparent form in FIG. 1). By using multiple staplers 56, staples can be placed in either end of the stack of sheets. The finishing device is shown as a stapler herein; however, as would be understood by those ordinarily skilled in the art, units 56 could be folding devices, binding devices, bookmaking units, laminating units, trimming units, etc., and the structures described herein can be used with any form of finishing device.

Figure 3:
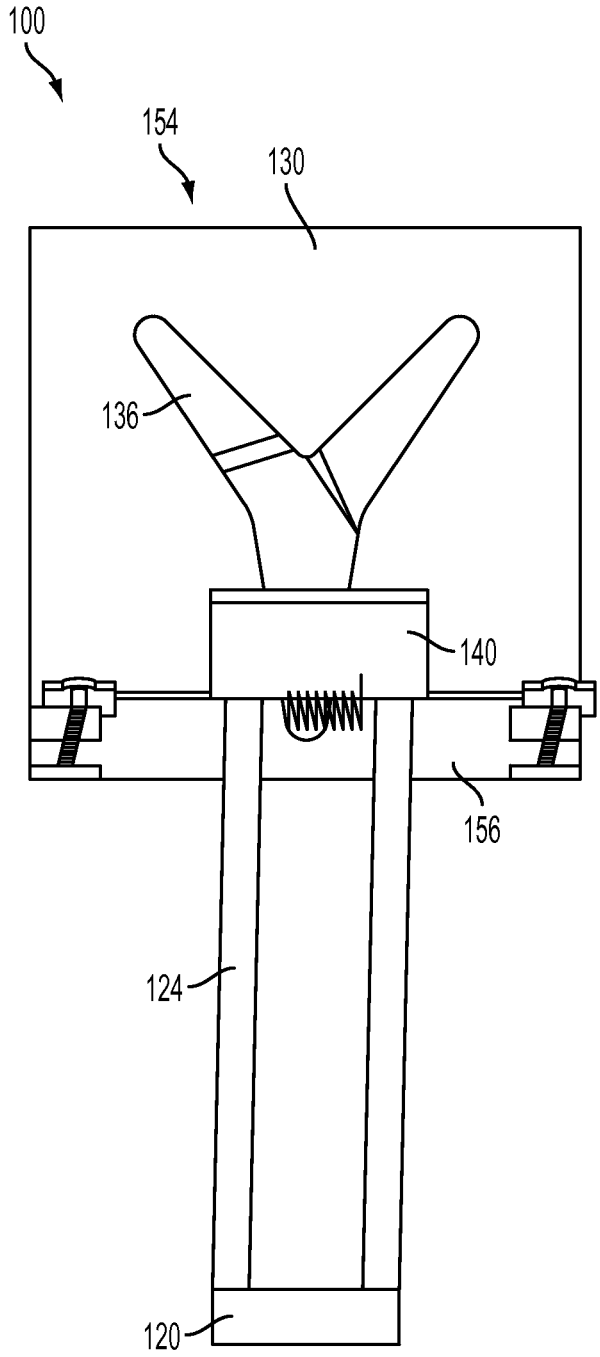
FIG. 3 is a top-view schematic diagram of a device according to embodiments herein.

Therefore, an exemplary finisher apparatus 100 herein (such as a stapler apparatus shown in the non-limiting exemplary drawings) can be used with any form of sheet processing device (such as a printer device). The stapler apparatus 100 includes a clamp 140 positioned to receive and stack sheets from the printing device 102. At least two electronic staplers 56 are positioned on opposite sides of the clamp 140 and a support plate 130 is positioned adjacent the clamp 140. The support plate 130 has a proximal end 154 facing toward the printing device 102 and a distal end 156 facing away from the printing device 102 (see FIG. 3).

Sheets are transported by the sheet transport 102 and are stacked on a support plate 122 (that is fixed in distance from the sheet transport 102). A clamp 140 (shown in FIGS. 2-19) is connected to a linkage 124 (such as a four bar linkage) with a drive unit or actuator 120 that comprises any device that can move the clamp. Thus, drive unit 120 can be a threaded member that supports a screw and moves when the screw is rotated, or the drive unit could be an actuator, piston, linear motor, etc.

Figure 4:
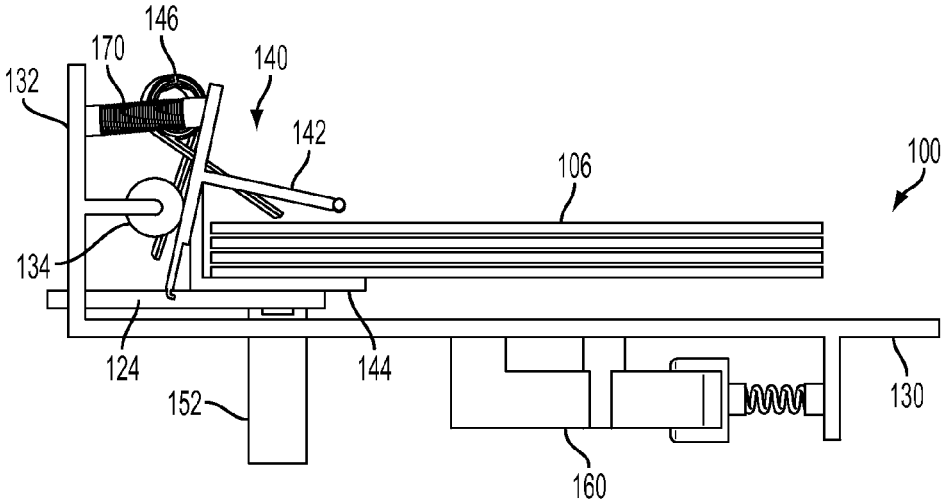
FIG. 4 is a side-view schematic diagram of a device according to embodiments herein.

In FIGS. 1-4 the clamp 140 is shown in the fully retracted position to collect sheets into a stack for stapling (shown in perspective views, top view, and side view, respectively). The support plate 130 includes a Y-shaped grove 136 that guides the clamp 140 into different locations to allow the stacks of sheets to be offset when ejected from the clamp 140. Note that only FIG. 4 illustrates the stack of stapled sheets 106 in order to allow the other features of the structures herein to be viewed more easily.

Thus, the support plate 130 has a Y-groove 136 (having the shape of the letter "Y" or any other forked shape). The clamp 140 is moveable relative to the support plate 130. The actuator 120 is connected to the clamp 140, and the actuator 120 moves the clamp 140 relative to the support plate 130 (by moving the clamp 140 toward and away from the printing device 102). To the contrary, the support plate 130 remains in a fixed position relative to the sheet transport 102.

The Y-groove 136 directs the clamp 140 along one path of multiple paths as the clamp 140 moves from the distal end 156 to the proximal end 154. The multiple paths, again, are in the shape of the letter Y. The multiple paths alternately direct the clamp 140 relatively closer to one of the staplers 56 (or the other stapler) as the clamp 140 moves from the distal end 156 to the proximal end 154 (along alternate ones of the multiple paths). The distal end 156 is relatively further away from the printer device sheet transport 102, and the proximal end 154 is relatively closer to the printer device sheet transport 102.

As shown in FIG. 4, the clamp 140 includes an upper clamp portion 142 and a lower clamp portion 144. The lower clamp portion 144 is fixed in position relative to the linkage 124; however, the upper clamp portion 142 rotates around an axle to move the upper clamp portion 142 closer to the lower clamp portion 144 in order to move the clamp from the open position to the closed position.

Thus, the clamp 140 has a first clamp section 142, a second clamp section 144, and an axle connecting the first clamp section 142 to the second claim section. The first clamp section 142 pivots around the axle and changes the relative locations of the ends of the first clamp section 142 and second clamp section 144 to move the clamp 140 between the open position and the closed position. Thus, the open position of the clamp 140 occurs when the clamp 140 has a larger space between the first clamp section 142 and the second clamp section 144 (relative to the closed position).

Further, a clamp biasing member 146 (such as a spring, etc.) is connected to the clamp 140 to bias the clamp toward the closed position. This clamp biasing member 146 is sometimes referred to herein as an arbitrarily named "first" biasing member and is connected to the clamp 140. The first biasing member 146 applies an arbitrarily named "first" force to the clamp 140 toward a closed position.

As shown first in FIG. 4, the support plate 130 includes one or more projections/extensions 132 integral with the support plate 130. One or more backstop features 134 of the projections 132, such as rollers, press against the upper clamp portion 142 to cause the clamp 140 to rotate up into the open position when the clamp 140 is fully retracted by the drive unit 120. Thus, an arbitrarily named "first" extension is connected to and extends from the distal end 156 of the support plate 130. The first extension 134 is positioned to contact the clamp 140 when the clamp 140 is located at the distal end 156 of the support plate 130. The first extension 134 applies a force (an arbitrarily named "second" force) to the clamp 140 toward an open position.

FIG. 4 also illustrates a pin 152 that is positioned in the groove 136 and a gate 160 that directs the pin 152 into one of the paths of the Y-groove 136. As shown in FIGS. 5-9 the clamp is moved to the fully extended position by the drive unit 120 (the clamp 140 is moved toward the sheet transport 102). Thus, with the clamp 140 in the fully retracted position, the set is sheets is stacked and stapled. When the clamp 140 is moved to the fully extended position, the stapled stack of sheets is simultaneously ejected and offset. Thus, the pin 152 is connected to the clamp 140. The pin 152 is positioned within the Y-groove 136 in the support plate 130, and the pin 152 is moveable along a length of the Y-groove 136.

More specifically, while being driven forward by the linear actuator 120/four bar linkage 124, the clamp 140 is not pressing against the backstop rollers 134, allowing the clamp spring 146 to keep the clamp closed 140, holding the stack of stapled sheet firmly in the clamp 140. Further, the groove 136 causes the clamp 140 to move to one side. When the clamp reaches the fully extended position (as shown in FIGS. 5-9) additional biasing members 170 pull on the top clamp portion 142, opening the clamp 140. More specifically, the biasing members 170 can comprise extension springs, or any type of force member. The biasing member 170 are shown as springs for example only, but can be any kind of retractable wire or physical hardstop that applies a retracting force at the extended position to open the clamp 140.

These biasing members 170 are sometime referred to herein as an arbitrarily named "second" biasing member 170, which is connected to the support plate 130 and to the clamp 140. For example, mounts can be connected to the distal end 156 of the support plate 130 and to the second biasing member 170. The second biasing member 170 applies an arbitrarily named "third" force to the clamp 140 toward the open position when the clamp 140 is positioned at the proximal end 154 of the support plate 130. The second force and the third force are each greater than the first force and overcome the first force to place the clamp 140 in the open position.

Figure 5:
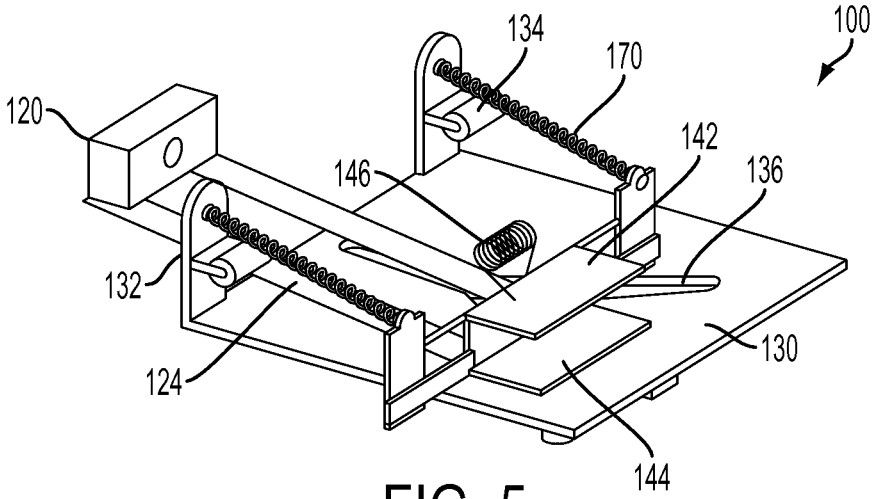
FIG. 5 is a perspective-view schematic diagram of a device according to embodiments herein.
Figure 6:
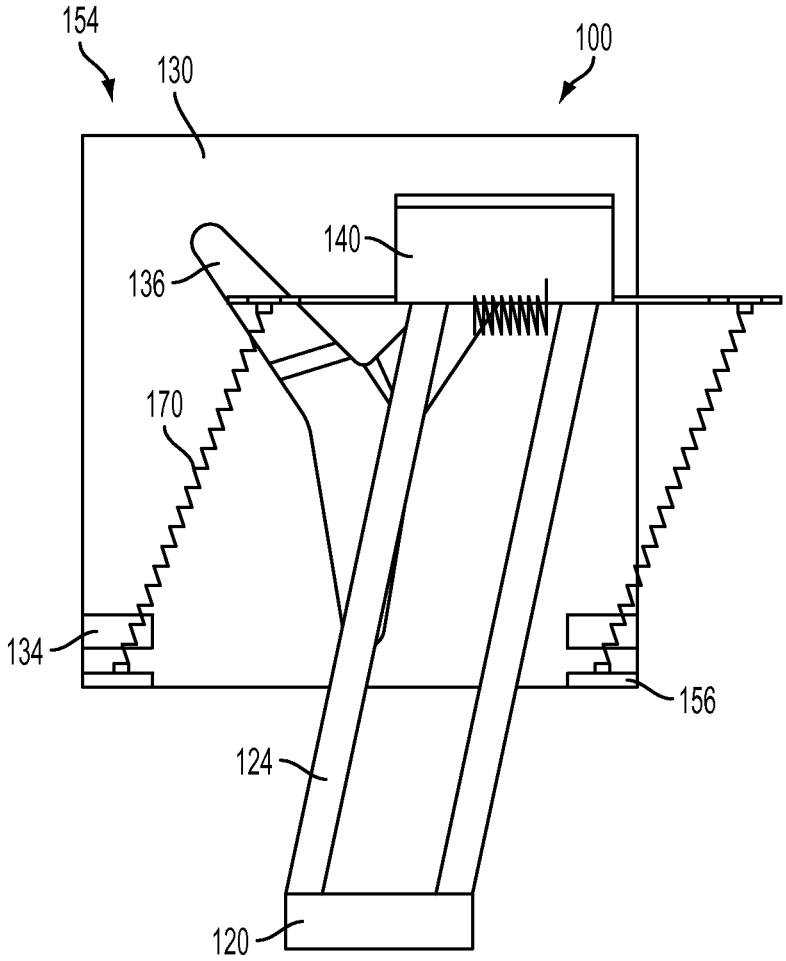
FIG. 6 is a top-view schematic diagram of a device according to embodiments herein.
Figure 7:
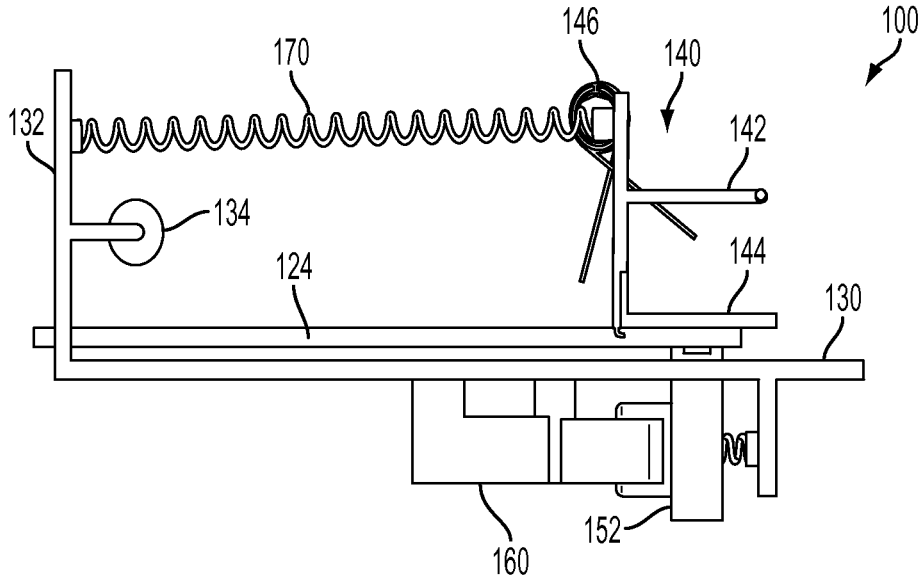
FIG. 7 is a side-view schematic diagram of a device according to embodiments herein.
Figure 8:
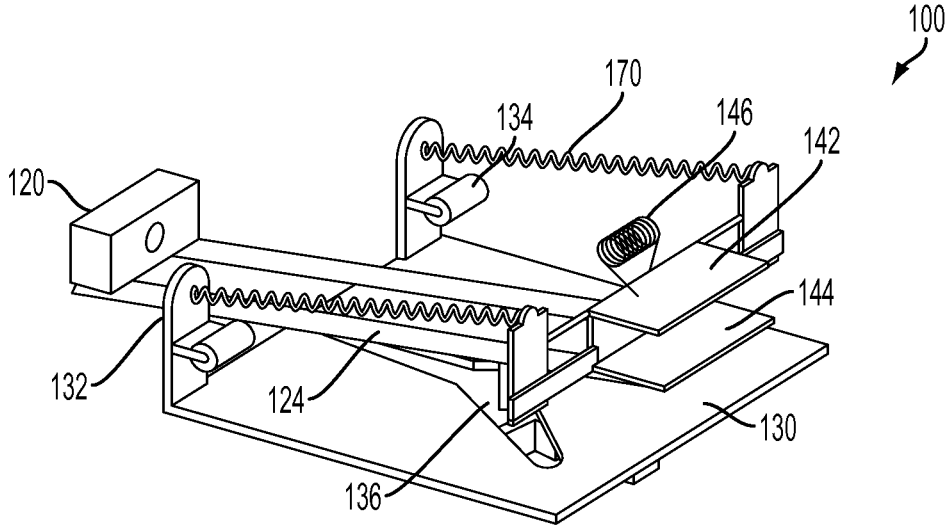
FIG. 8 is a perspective-view schematic diagram of a device according to embodiments herein.
Figure 9:
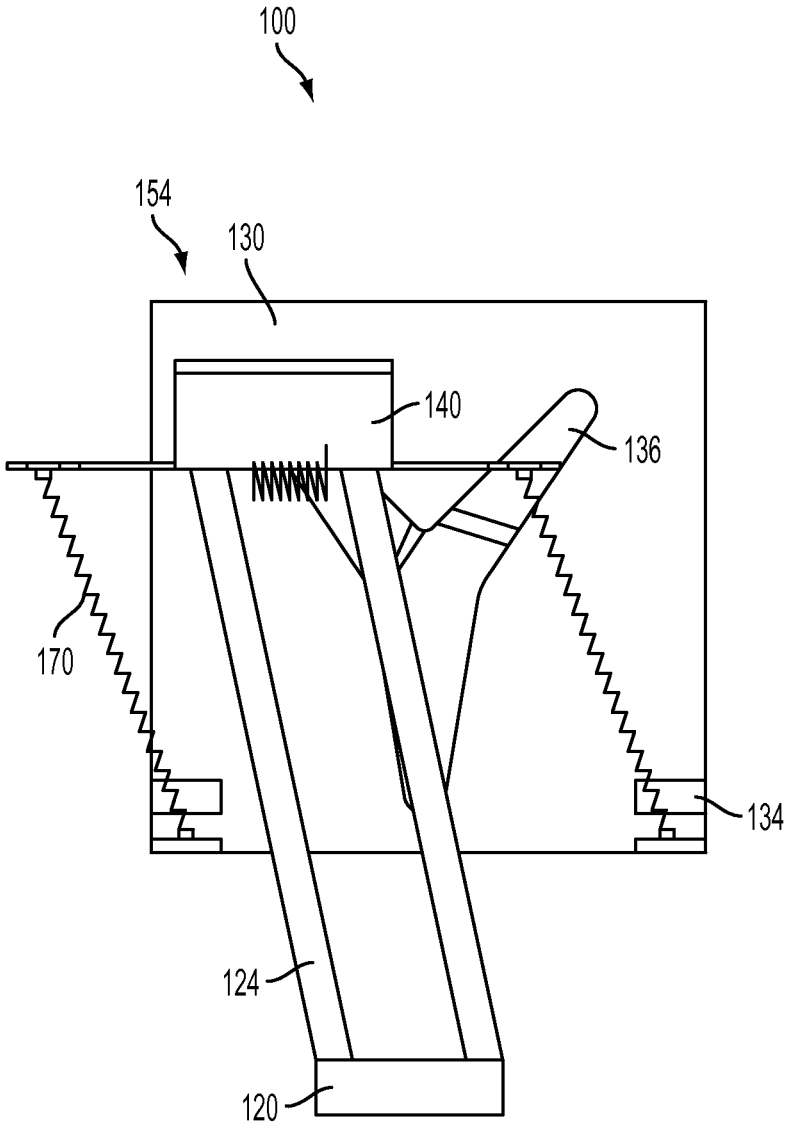
FIG. 9 is a top-view schematic diagram of a device according to embodiments herein.

The lack of force applied to the upper clamp portion 142 allows the torsion spring 146 to press the clamp 140 down on the stapled set while the clamp 140 in moving between the retracted and extended positions. When the clamp 140 reaches the end point of travel in the fully extended position, the extension spring 170 will engage and rotate the upper portion of the clamp 142 up and open, freeing the stapled set to be stacked on the inboard (or outboard) side. FIGS. 5 and 6 illustrate (in perspective and top views, respectively) the clamp traveling down one of the groove sections and FIGS. 8 and 9 illustrate (in perspective and top views, respectively) the clamp traveling down the other groove section.

Also, the gate 160 is connected to the support plate 130. The gate 160 directs the pin 152 into one of the multiple paths of the Y-groove 136. A biased roller 162 contacts the gate, and an arbitrarily named "third" biasing member 164 applies an arbitrarily named "fourth" force to the biased roller 162. The biased roller 162 changes the position of the gate 160, causing the gate 160 to alternately direct the pin 152 into the alternate ones of the multiple paths 136.

Figure 10:
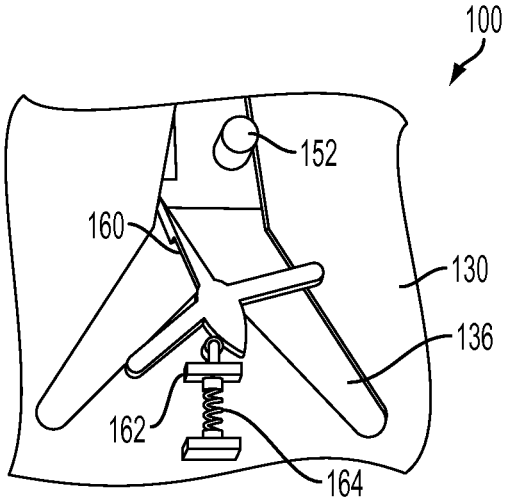
FIG. 10 is a bottom-view schematic diagram of a device according to embodiments herein.
Figure 11:
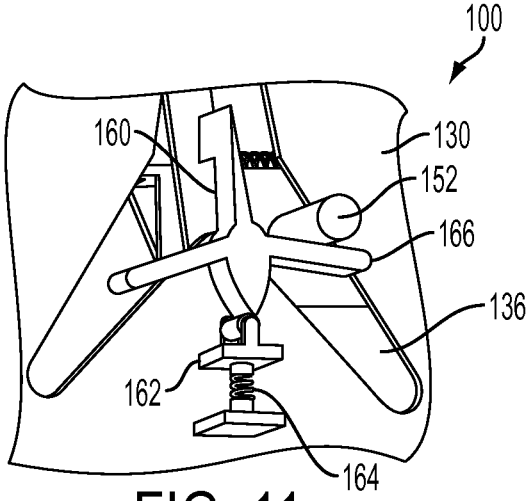
FIG. 11 is a bottom-view schematic diagram of a device according to embodiments herein.
Figure 12:
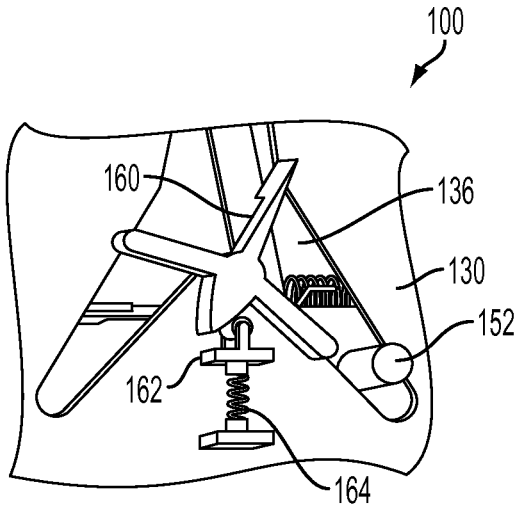
FIG. 12 is a bottom-view schematic diagram of a device according to embodiments herein.

FIGS. 10-18 are bottom-views showing the operation of the gate 160 causing the pin 152 to alternately travel down different paths of the Y-groove 136. A biasing member 164 causes a roller 162 to press against a bottom cam portion of the gate 160. As shown in FIG. 10, after collecting the set of sheets and stapling, the guide pin 152 is driven forward, with the gate 160 already biased to one side. In FIG. 11, the pin 152 begins down one leg of the "Y" slot 136 and pushes on a cam leg 166 of the gate 160. Then, as shown in FIG. 12, pressure from the roller 162 causes the gate 160 to rotate further to one side, causing the gate 160 to go over center and bias the gate 160 on the opposite side against a hard stop.

Figure 13:
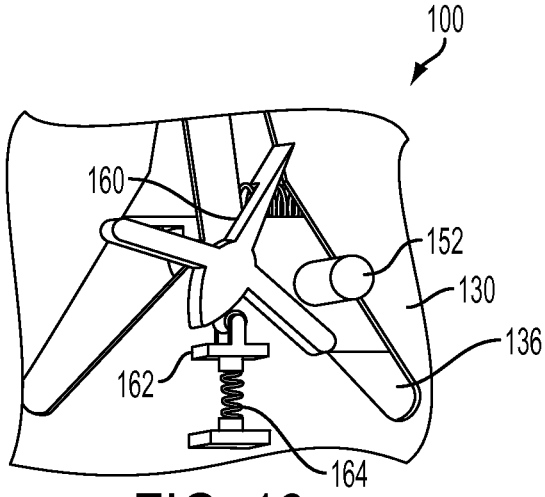
FIG. 13 is a bottom-view schematic diagram of a device according to embodiments herein.
Figure 14:
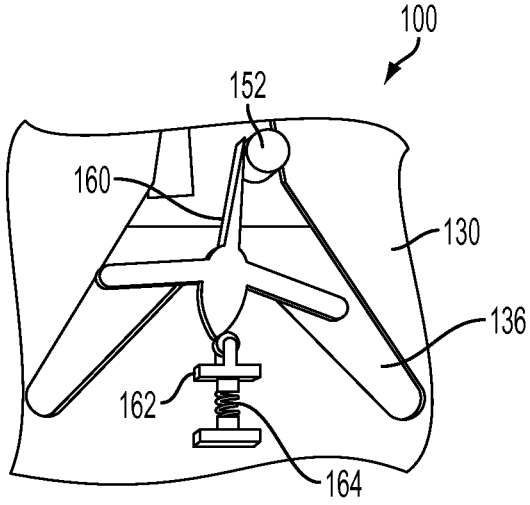
FIG. 14 is a bottom-view schematic diagram of a device according to embodiments herein.
Figure 15:
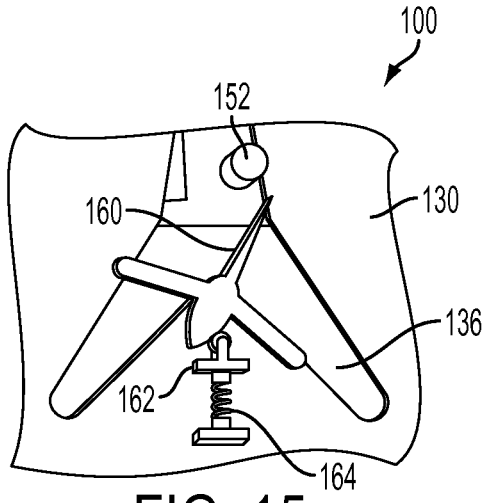
FIG. 15 is a bottom-view schematic diagram of a device according to embodiments herein.
Figure 16:
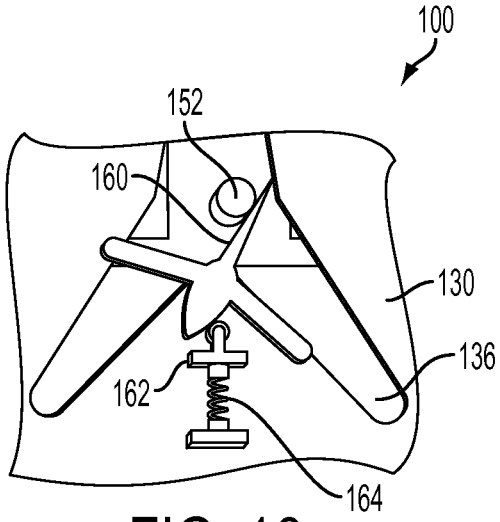
FIG. 16 is a bottom-view schematic diagram of a device according to embodiments herein.
Figure 17:
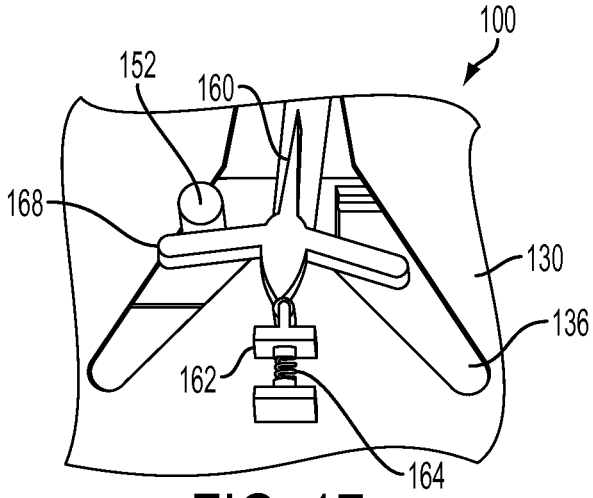
FIG. 17 is a bottom-view schematic diagram of a device according to embodiments herein.
Figure 18:
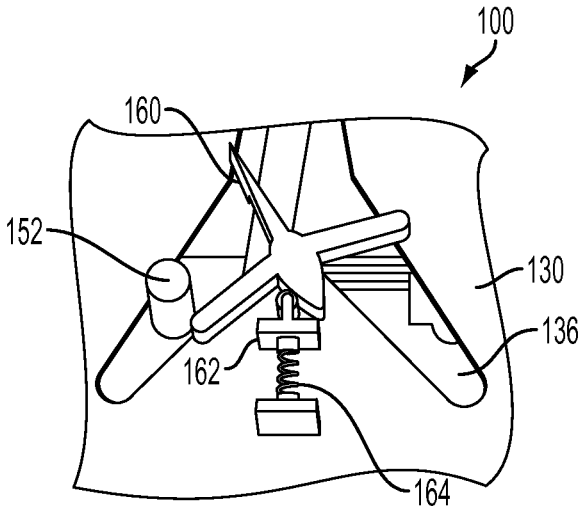
FIG. 18 is a bottom-view schematic diagram of a device according to embodiments herein.

Next in FIG. 13, after ejecting the stapled set of sheets, the guide pin 152 begins returning up the path of the Y-groove 136. As shown in FIG. 14, the pin 152 pushes by the gate 160, but does not push the gate 160 far enough to cause the gate 160 to switch positions, and the force from the roller 162 keeps the gate 160 in the same position. Thus, because the gate 160 is pressed to the outside by the roller 162, and the slot 136 is wide enough, the pin 152 passes past the gate 160 without causing the gate 160 to go over center, and consequently the gate 160 does not switch sides (as shown in FIG. 15. Next, as shown in FIG. 16, after collecting and stapling the next sequential set of sheets, the clamp 140 and pin 152 travel toward the fully extended position so as to eject the stapled set of sheets. Because the gate 160 position was switched in FIGS. 11 and 12, the gate 160 now causes the pin 152 to travel down the other slot 136, as shown in FIG. 17. Further, in FIG. 17, the pin 152 again contacts one of the cam legs 168, which rotates the gate 160 towards the other side and eventually against the other hard stop, as shown in FIG. 18. The process shown in FIG. 10-18 continually repeats, causing the pin to alternately travel down opposite paths of the Y-groove 136, which in turn causes each stacked and stapled sheet to be offset from the immediately preceding stapled sheet set.

Figure 19:
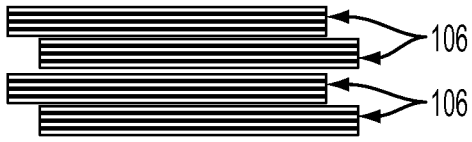
FIG. 19 is a side-view schematic diagram of a sets of stabled sheets offset according to embodiments herein.

In operation, the clamp 140 grasps stacks of sheets after the staplers 56 have stapled the stacks of sheets. The clamp 140 alternately offsets the stacks of stapled sheets by traveling along alternate ones of the multiple paths of the Y-groove 136 while sequentially clamping successive stacks of stapled sheets. An example of multiple stacks of stapled sheets 106, offset from one another in a stack as produced by this structure is shown in FIG. 19.

Figure 20:
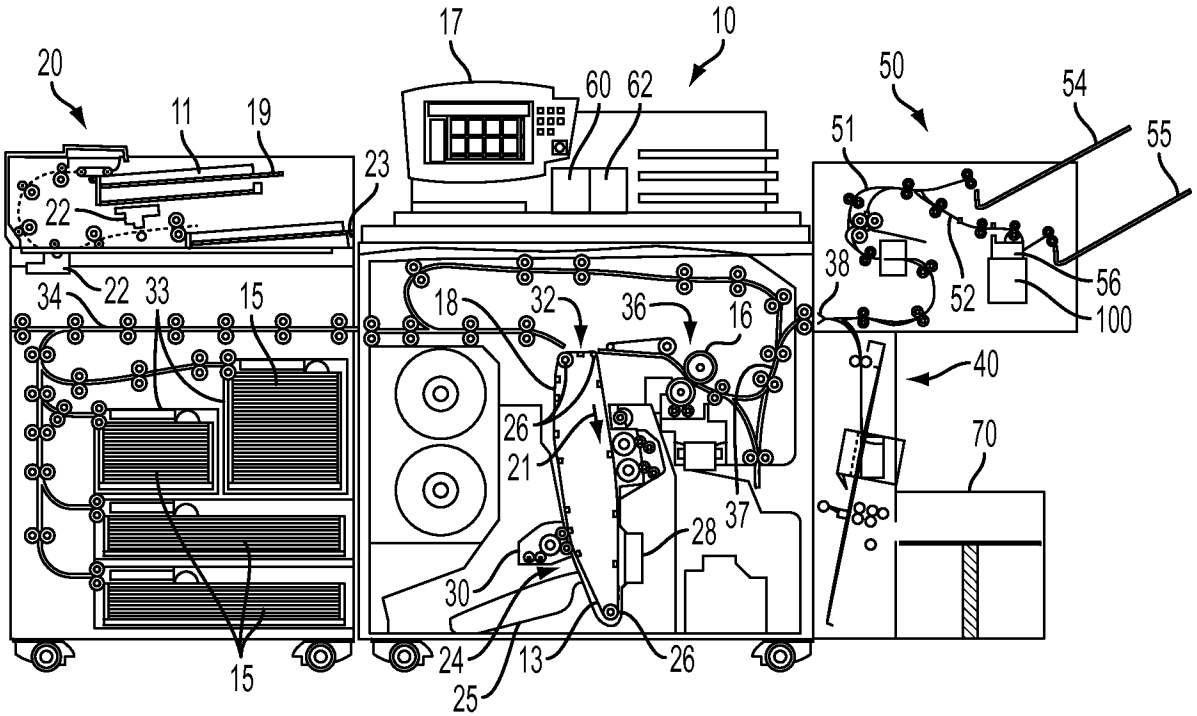
FIG. 20 is a side-view schematic diagram of a device according to embodiments herein.

Referring to FIG. 20 a printing machine 10 is shown that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing station 30, and transfer station 32.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices which contact and handle sheets within finisher module 50 are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 in combination with the offset stacking device 100 discussed above, and is used for most jobs that require stacking or stapling.

As would be understood by those ordinarily skilled in the art, the printing device 10 shown in FIG. 20 is only one example and the embodiments herein are equally applicable to other types of printing devices that may include fewer components or more components. For example, while a limited number of printing engines and paper paths are illustrated in FIG. 20, those ordinarily skilled in the art would understand that many more paper paths and additional printing engines could be included within any printing device used with embodiments herein.

Thus, the structures and methods herein provide cross process offsetting at the ejection point where the controlled clamp opening is position dependent. These structures use a cam driven gate with leg actuators to consistently provide offset of subsequent stapled sheet sets. This provides faster offsetting time, with less skipped pitches than structures that move the entire stapling assembly. Further, this provides increased paper control of the clamped sets during offsetting, is less expensive because it can use only one linear actuator for the entire process/structure. This means that fewer resources are needed, and no additional software is required for clamp timing and gate change.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A stapler apparatus for use with a printing device, said stapler apparatus comprising:

a clamp positioned to receive and stack sheets from said printing device;

two staplers positioned on opposite sides of said clamp;

a support plate positioned adjacent said clamp, said support plate comprising a proximal end facing toward said printing device and a distal end facing away from said printing device, said support plate comprising a groove, said clamp being moveable relative to said support plate, said groove directing said clamp along one path of multiple paths as said clamp moves from said distal end to said proximal end, said multiple paths alternately directing said clamp relatively closer to one of said staplers and another of said staplers as said clamp moves from said distal end to said proximal end along alternate ones of said multiple paths;

a first biasing member connected to said clamp, said first biasing member applying a first force to said clamp toward a closed position;

a first extension connected to said distal end of said support plate, said first extension being positioned to contact said clamp when said clamp is located at said distal end of said support plate, said first extension applying a second force to said clamp toward an open position, said open position of said clamp occurring when said clamp has a larger clamp opening relative to said closed position;

a second biasing member connected to said support plate and to said clamp, said second biasing member applying a third force to said clamp toward said open position when said clamp is positioned at said proximal end of said support plate;

a pin connected to said clamp, said pin being positioned within said groove in said support plate, said pin being moveable along a length of said groove;

a gate connected to said support plate, said gate directing said pin into one of said multiple paths of said groove;

a biased roller contacting said gate; and a third biasing member applying a fourth force to said biased roller, said biased roller changing a position of said gate, causing said gate to alternately direct said pin into said alternate ones of said multiple paths.

2. The stapler apparatus according to claim 1, said second force and said third force each being greater than said first force.

3. The stapler apparatus according to claim 1, said clamp comprising a first clamp section, a second clamp section, and an axle connecting said first clamp section to said second claim section, said first clamp section pivoting around said axle to move said clamp between said open position and said closed position.

4. The stapler apparatus according to claim 1, further comprising an actuator connected to said clamp, said actuator moving said clamp relative to said support plate.

5. The stapler apparatus according to claim 1, further comprising mounts connected to said distal end of said support plate and to said second biasing member.

6. A stapler apparatus for use with a printing device, said stapler apparatus comprising:

a clamp positioned to receive and stack sheets from said printing device;

two electronic staplers positioned on opposite sides of said clamp;

a support plate positioned adjacent said clamp, said support plate comprising a proximal end facing toward said printing device and a distal end facing away from said printing device, said support plate comprising a Y-groove having a shape of the letter Y, said clamp being moveable relative to said support plate, said Y-groove directing said clamp along one path of multiple paths as said clamp moves from said distal end to said proximal end, said multiple paths being in said shape of said letter Y, said multiple paths alternately directing said clamp relatively closer to one of said staplers and another of said staplers as said clamp moves from said distal end to said proximal end along alternate ones of said multiple paths;

a first biasing member connected to said clamp, said first biasing member applying a first force to said clamp toward a closed position;

a first extension connected to said distal end of said support plate, said first extension being positioned to contact said clamp when said clamp is located at said distal end of said support plate, said first extension applying a second force to said clamp toward an open position, said open position of said clamp occurring when said clamp has a larger clamp opening relative to said closed position;

a second biasing member connected to said support plate and to said clamp, said second biasing member applying a third force to said clamp toward said open position when said clamp is positioned at said proximal end of said support plate;

a pin connected to said clamp, said pin being positioned within said Y-groove in said support plate, said pin being moveable along a length of said Y-groove;

a gate connected to said support plate, said gate directing said pin into one of said multiple paths of said Y-groove;

a biased roller contacting said gate; and a third biasing member applying a fourth force to said biased roller, said biased roller changing a position of said gate, causing said gate to alternately direct said pin into said alternate ones of said multiple paths.

7. The stapler apparatus according to claim 6, said second force and said third force each being greater than said first force.

8. The stapler apparatus according to claim 6, said clamp comprising a first clamp section, a second clamp section, and an axle connecting said first clamp section to said second claim section, said first clamp section pivoting around said axle to move said clamp between said open position and said closed position.

9. The stapler apparatus according to claim 6, further comprising an actuator connected to said clamp, said actuator moving said clamp relative to said support plate.

10. The stapler apparatus according to claim 6, further comprising mounts connected to said distal end of said support plate and to said second biasing member.

11. A stapler apparatus for use with a printing device, said stapler apparatus comprising:

a clamp positioned to receive and stack sheets from said printing device;

two electronic staplers positioned on opposite sides of said clamp;

a support plate positioned adjacent said clamp, said support plate comprising a proximal end facing toward said printing device and a distal end facing away from said printing device, said support plate comprising a Y-groove having a shape of the letter Y, said clamp being moveable relative to said support plate, said Y-groove directing said clamp along one path of multiple paths as said clamp moves from said distal end to said proximal end, said multiple paths being in said shape of said letter Y, said multiple paths alternately directing said clamp relatively closer to one of said staplers and another of said staplers as said clamp moves from said distal end to said proximal end along alternate ones of said multiple paths;

a first biasing member connected to said clamp, said first biasing member applying a first force to said clamp toward a closed position;

a first extension connected to said distal end of said support plate, said first extension being positioned to contact said clamp when said clamp is located at said distal end of said support plate, said first extension applying a second force to said clamp toward an open position, said open position of said clamp occurring when said clamp has a larger clamp opening relative to said closed position;

a second biasing member connected to said support plate and to said clamp, said second biasing member applying a third force to said clamp toward said open position when said clamp is positioned at said proximal end of said support plate;

a pin connected to said clamp, said pin being positioned within said Y-groove in said support plate, said pin being moveable along a length of said Y-groove;

a gate connected to said support plate, said gate directing said pin into one of said multiple paths of said Y-groove;

a biased roller contacting said gate; and a third biasing member applying a fourth force to said biased roller, said biased roller changing a position of said gate, causing said gate to alternately direct said pin into said alternate ones of said multiple paths, said clamp grasping stacks of sheets after said staplers have stapled said stacks of sheets, and said clamp alternately offsetting stacks of stapled sheets by traveling along alternate ones of said multiple paths of said Y-groove while sequentially clamping successive ones of said stacks of stapled sheets.

12. The stapler apparatus according to claim 11, said second force and said third force each being greater than said first force.

13. The stapler apparatus according to claim 11, said clamp comprising a first clamp section, a second clamp section, and an axle connecting said first clamp section to said second claim section, said first clamp section pivoting around said axle to move said clamp between said open position and said closed position.

14. The stapler apparatus according to claim 11, further comprising an actuator connected to said clamp, said actuator moving said clamp relative to said support plate.

15. The stapler apparatus according to claim 11, further comprising mounts connected to said distal end of said support plate and to said second biasing member.

* * * * *